US009945384B2

(12) United States Patent
Oda et al.

(10) Patent No.: US 9,945,384 B2
(45) Date of Patent: Apr. 17, 2018

(54) TURBO COMPRESSOR AND TURBO REFRIGERATOR

(71) Applicant: DAIKIN INDUSTRIES, LTD., Osaka-shi, Osaka (JP)

(72) Inventors: Kentarou Oda, Tokyo (JP); Nobuyoshi Sakuma, Tokyo (JP); Katsuya Fujisaku, Tokyo (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 161 days.

(21) Appl. No.: 14/904,868

(22) PCT Filed: Jul. 14, 2014

(86) PCT No.: PCT/JP2014/068736
§ 371 (c)(1),
(2) Date: Jan. 13, 2016

(87) PCT Pub. No.: WO2015/008733
PCT Pub. Date: Jan. 22, 2015

(65) Prior Publication Data

US 2016/0169236 A1 Jun. 16, 2016

(30) Foreign Application Priority Data

Jul. 18, 2013 (JP) ..... 2013-149464

(51) Int. Cl.
*F04D 25/06* (2006.01)
*F25B 1/053* (2006.01)
(Continued)

(52) U.S. Cl.
CPC ..... *F04D 25/06* (2013.01); *F04D 17/122* (2013.01); *F04D 25/02* (2013.01); *F04D 29/08* (2013.01);
(Continued)

(58) Field of Classification Search
CPC ..... F04D 25/06; F04D 25/02; F04D 29/403; F04D 17/122; F04D 29/4206;
(Continued)

(56) References Cited

U.S. PATENT DOCUMENTS 3,637,329 A 1/1972 Sato et al.
4,688,989 A * 8/1987 Kondo ..... F04D 25/02 415/113
(Continued)

FOREIGN PATENT DOCUMENTS

CN 101963160 A 2/2011
CN 102135103 A 2/2011
(Continued)

OTHER PUBLICATIONS

International Search Report, issued in PCT/JP2014/068736, dated Sep. 30, 2014.

*Primary Examiner* — Emmanuel Duke
(74) *Attorney, Agent, or Firm* — Birch, Stewart, Kolasch & Birch, LLP

(57) ABSTRACT

A turbo compressor includes: a compressor casing which accommodates impellers compressing gas by rotation; and a motor casing which accommodates a motor rotating the impellers, wherein the motor casing has a cylindrical main body part having a larger diameter than a mounting flange provided in the compressor casing, and the compressor casing and the motor casing are connected through an adapter member.

11 Claims, 7 Drawing Sheets

(51) Int. Cl.

| | |
|---|---|
| ***F04D 17/12*** | (2006.01) |
| ***F04D 29/42*** | (2006.01) |
| ***F04D 29/62*** | (2006.01) |
| ***F04D 29/08*** | (2006.01) |
| ***F04D 29/40*** | (2006.01) |
| ***F04D 25/02*** | (2006.01) |
| *F25B 1/10* | (2006.01) |
| *F25B 25/00* | (2006.01) |
| *F25B 31/02* | (2006.01) |

(52) U.S. Cl.
CPC ..... *F04D 29/403* (2013.01); *F04D 29/4206* (2013.01); *F04D 29/624* (2013.01); *F25B 1/053* (2013.01); *F25B 1/10* (2013.01); *F25B 25/005* (2013.01); *F25B 31/026* (2013.01); *F25B 2339/047* (2013.01); *F25B 2341/0662* (2013.01); *F25B 2400/13* (2013.01); *F25B 2400/23* (2013.01); *F25B 2500/01* (2013.01)

(58) Field of Classification Search
CPC .. F04D 29/624; F25B 1/053; F25B 2339/047; F25B 25/005; F25B 1/10; F25B 2341/0662; F25B 2400/13; F25B 2400/23; F25B 2500/01; F25B 1/05
See application file for complete search history.

(56) References Cited

U.S. PATENT DOCUMENTS

| | | | | |
|---|---|---|---|---|
| 6,036,452 | A | 3/2000 | Huang | |
| 6,196,809 | B1 | 3/2001 | Takahashi et al. | |
| 2002/0014088 | A1 | 2/2002 | Seki et al. | |
| 2005/0196306 | A1* | 9/2005 | Del Zanno ..... | F04D 25/06 417/423.15 |
| 2011/0016913 | A1 | 1/2011 | Tsukamoto et al. | |
| 2011/0182725 | A1 | 7/2011 | Rasmussen et al. | |
| 2011/0236202 | A1 | 9/2011 | Tsukamoto et al. | |
| 2011/0239694 | A1 | 10/2011 | Sugitani et al. | |
| 2013/0039746 | A1 | 2/2013 | Kurihara | |

FOREIGN PATENT DOCUMENTS

| | | | |
|---|---|---|---|
| EP | 1795754 | A2 | 6/2007 |
| JP | 50-38801 | B | 12/1975 |
| JP | 51-47042 | Y | 11/1976 |
| JP | 7-86356 | B2 | 9/1995 |
| JP | 10-259796 | A | 9/1998 |
| JP | 2002-48098 | A | 2/2002 |
| JP | 2011-169198 | A | 9/2011 |
| JP | 2011-223679 | A | 11/2011 |

* cited by examiner

TURBO COMPRESSOR AND TURBO REFRIGERATOR

TECHNICAL FIELD

The present invention relates to a turbo compressor and a turbo refrigerator.

Priority is claimed on Japanese Patent Application No. 2013-149464, filed on Jul. 18, 2013, the content of which is incorporated herein by reference.

BACKGROUND ART

As a refrigerator, a turbo refrigerator, which is provided with a turbo compressor which compresses a refrigerant by rotating an impeller by a motor and discharges the compressed refrigerant, is known. The turbo compressor is assembled by connecting a compressor casing which accommodates the impeller, and a motor casing which accommodates the motor.

Patent Document 1 discloses a structure of connecting a compressor casing and a motor casing. The motor casing has a main body part formed in a cylindrical shape, and a mounting flange extending in a radial direction from the main body part. A mounting flange having the same diameter as the mounting flange of the motor casing is provided in the compressor casing, and both the mounting flanges are connected by a connecting bolt, whereby a turbo compressor is assembled (refer to FIG. 2 of Patent Document 1).

CITATION LIST

Patent Document

[Patent Document 1] Japanese Unexamined Patent Application, First Publication No. 2011-223679

SUMMARY OF INVENTION

Technical Problem

In a motor for a turbo compressor, a width is present in voltage according to the specifications, and thus the diameter of the motor is also increased to correspond to the magnitude of the voltage. If the diameter of the motor is increased, a motor casing which accommodates the motor must also be increased. Therefore, in the related art, the compressor casing is also increased to correspond to the size of the motor casing and the two are connected.

However, the compressor casing has a flow path or the like for compressing gas formed therein and has a complicated shape. Therefore, whenever the voltage of the motor is changed, if a compressor casing having a size corresponding thereto is manufactured, an inventory location or an inventory cost is also required.

The present invention has been made in view of the above-described circumstances and has an object to provide a turbo compressor and a turbo refrigerator in which connection of a compressor casing and a motor casing is possible without changing the size of the compressor casing.

Solution to Problem

In a first aspect of the present invention, there is provided a turbo compressor including: a compressor casing which accommodates an impeller compressing gas by rotation; and a motor casing which accommodates a motor rotating the impeller, wherein the motor casing has a cylindrical main body part having a larger diameter than a mounting flange provided in the compressor casing, and the compressor casing and the motor casing are connected through an adapter member.

In the first aspect of the present invention, the turbo compressor is assembled by connecting the compressor casing and the motor casing by interposing the adapter member therebetween. In a case where the diameter of the main body part of the motor casing is smaller than that of the mounting flange of the compressor casing, it is possible to cope with it only by changing the size of the motor casing having a simple shape (for example, extending a mounting flange of the motor casing, or the like). However, in a case where the diameter of the main body part of the motor casing is greater than the diameter of the mounting flange of the compressor casing according to the specification of the voltage of the motor, the compressor casing cannot be directly connected to the motor casing without changing the size of the compressor casing. Therefore, in the first aspect of the present invention, the adapter member is separately prepared, and even if the size of the motor casing is changed, the adapter member is interposed, whereby it is not necessary to change the size of the compressor casing.

In a second aspect of the present invention, in accordance with the first aspect, the adapter member has a first connection portion which can be connected to the mounting flange provided in the compressor casing, in a first diameter, and a second connection portion which can be connected to the mounting flange provided in the motor casing, in a second diameter greater than the first diameter.

In the second aspect of the present invention, the adapter member is connected to the mounting flange of the compressor casing at the first diameter in the first connection portion and connected to the mounting flange of the motor casing at the second diameter greater than the first diameter in the second connection portion. For this reason, in the second aspect of the present invention, it is possible to connect the compressor casing and the motor casing which have the mounting flanges different in size from each other, by interposing the adapter member therebetween.

In a third aspect of the present invention, in accordance with the second aspect, the adapter member has an annular groove in which a seal member, which performs airtight sealing between the adapter member and the compressor casing or the motor casing, is disposed.

In the third aspect of the present invention, the seal member is disposed in the annular groove provided in the adapter member, thereby performing airtight sealing between the adapter member and the compressor casing or the motor casing. If the compressor casing and the motor casing are connected by interposing the adapter member therebetween, one connection place between the compressor casing and the motor casing further increases, and therefore, it is necessary to additionally dispose the seal member in order to prevent leakage of gas from the connection place. Therefore, in the third aspect of the present invention, the annular groove is formed in the adapter member, and an additional seal member can be disposed without changing the shape of the compressor casing or the motor casing.

In a fourth aspect of the present invention, in accordance with the third aspect, the annular groove has a diameter smaller than the first diameter.

In the fourth aspect of the present invention, the seal member can be disposed further toward the inside than the first diameter to which the mounting flange of the compressor casing is connected, and therefore, it is possible to prevent leakage of gas from the first connection portion.

In a fifth aspect of the present invention, in accordance with any one of the first to fourth aspects, the turbo compressor further includes: a first seal member which performs airtight sealing between the compressor casing and the adapter member; and a second seal member which performs airtight sealing between the motor casing and the adapter member, wherein the first seal member and the second seal member have the same diameter.

In the fifth aspect of the present invention, a connection place of the compressor casing and a connection place of the motor casing, which are generated due to the interposition of the adapter member, are respectively sealed by the seal members having the same diameter. Accordingly, in the fifth aspect of the present invention, the same pressure receiving area as in a case where the compressor casing and the motor casing are directly connected can be maintained. For this reason, in the fifth aspect of the present invention, it is possible to connect the compressor casing and the motor casing by interposing the adapter member therebetween, without increasing the diameter of a connecting bolt.

In a sixth aspect of the present invention, there is provided a turbo refrigerator including: a condenser which liquefies a compressed refrigerant; an evaporator which evaporates the refrigerant liquefied by the condenser, thereby cooling a cooling object; and the turbo compressor according to any one of the first to fifth aspects, which compresses the refrigerant evaporated by the evaporator and supplies the compressed refrigerant to the condenser.

Advantageous Effects of Invention

According to the present invention, a turbo compressor and a turbo refrigerator are obtained in which connection of a compressor casing and a motor casing is possible without changing the size of the compressor casing.

DESCRIPTION OF EMBODIMENTS

Hereinafter, embodiments of the present invention will be described with reference to the drawings.

Figure 1:
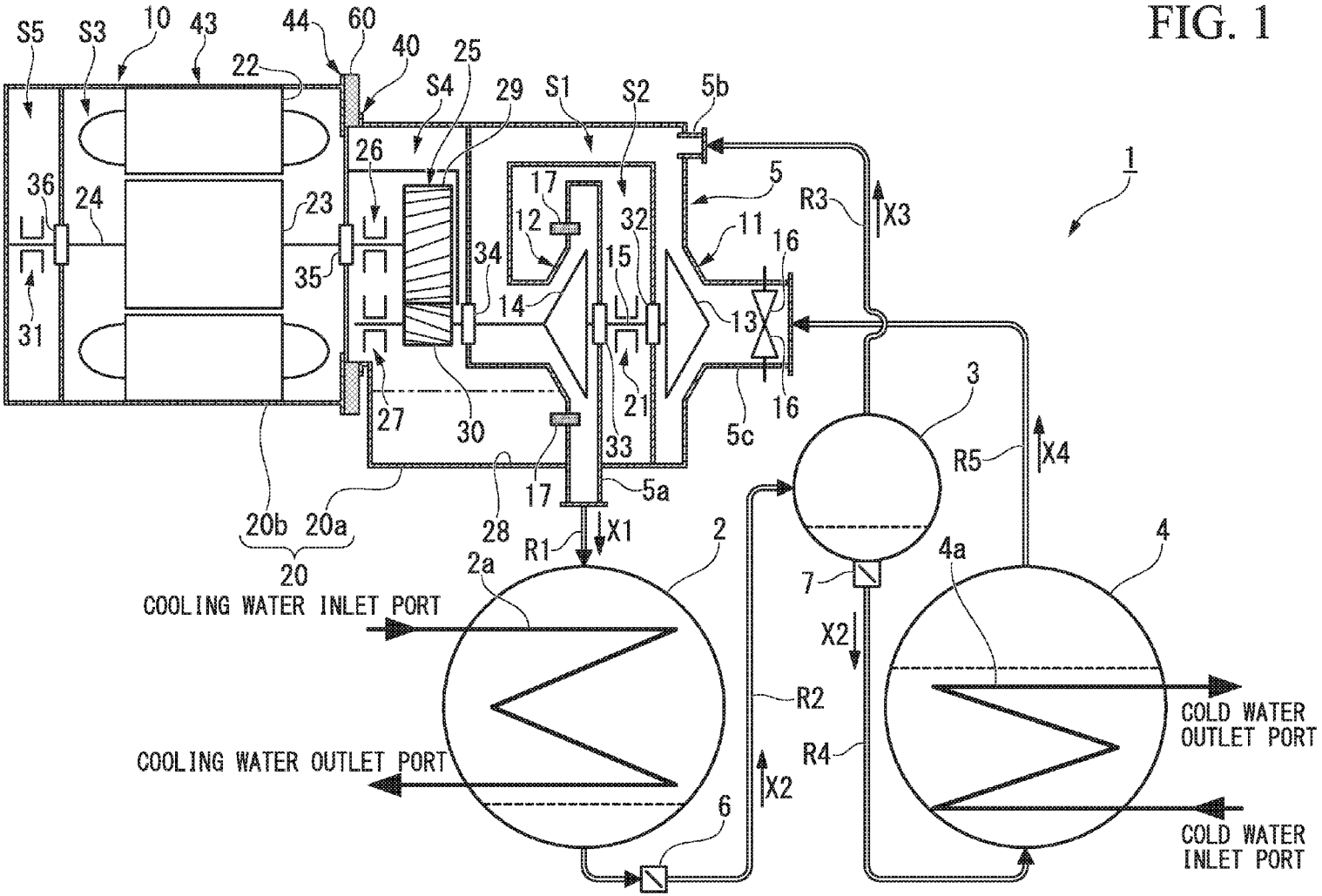
FIG. 1 is a system diagram of a turbo refrigerator in an embodiment of the present invention.

FIG. 1 is a system diagram of a turbo refrigerator 1 in an embodiment of the present invention.

In the turbo refrigerator 1 of this embodiment, for example, a chlorofluorocarbon is used as a refrigerant and cold water for air conditioning is set to be a cooling object. The turbo refrigerator 1 is provided with a condenser 2, an economizer 3, an evaporator 4, and a turbo compressor 5, as shown in FIG. 1.

The condenser 2 is connected to a gas discharge pipe 5*a* of the turbo compressor 5 through a flow path R1. A refrigerant (a compressed refrigerant gas X1) compressed by the turbo compressor 5 is supplied to the condenser 2 through the flow path R1. The condenser 2 liquefies the compressed refrigerant gas X1. The condenser 2 is provided with a heat exchanger tube 2*a* through which cooling water flows, and cools the compressed refrigerant gas X1 by heat exchange between the compressed refrigerant gas X1 and the cooling water.

The compressed refrigerant gas X1 is cooled and liquefied by heat exchange between itself and the cooling water, thereby becoming a refrigerant liquid X2, and the refrigerant liquid X2 accumulates in a bottom portion of the condenser 2. The bottom portion of the condenser 2 is connected to the economizer 3 through a flow path R2. An expansion valve 6 for decompressing the refrigerant liquid X2 is provided in the flow path R2. The refrigerant liquid X2 decompressed by the expansion valve 6 is supplied to the economizer 3 through the flow path R2. The economizer 3 temporarily stores the decompressed refrigerant liquid X2 and separates the refrigerant into a liquid phase and a gas phase.

A top portion of the economizer 3 is connected to an economizer connecting pipe 5*b* of the turbo compressor 5 through a flow path R3. A gas-phase component X3 of the refrigerant separated out by the economizer 3 is supplied to a second compression stage 12 through the flow path R3 without passing through the evaporator 4 and a first compression stage 11, and thus the efficiency of the turbo compressor 5 is increased. On the other hand, a bottom portion of the economizer 3 is connected to the evaporator 4 through a flow path R4. An expansion valve 7 for further decompressing the refrigerant liquid X2 is provided in the flow path R4.

The refrigerant liquid X2 further decompressed by the expansion valve 7 is supplied to the evaporator 4 through the flow path R4. The evaporator 4 evaporates the refrigerant liquid X2 and cools cold water using the heat of vaporization. The evaporator 4 is provided with a heat exchanger tube 4*a* through which the cold water flows, and causes the cooling of the cold water and the evaporation of the refrigerant liquid X2 by heat exchange between the refrigerant liquid X2 and the cold water. The refrigerant liquid X2 evaporates by taking in heat by heat exchange between itself and the cold water, thereby becoming a refrigerant gas X4.

A top portion of the evaporator 4 is connected to a gas suction pipe 5*c* of the turbo compressor 5 through a flow path R5. The refrigerant gas X4 having evaporated in the evaporator 4 is supplied to the turbo compressor 5 through the flow path R5. The turbo compressor 5 compresses the refrigerant gas X4 having evaporated and supplies it to the condenser 2 as the compressed refrigerant gas X1. The turbo compressor 5 is a two-stage compressor which is provided with the first compression stage 11 which compresses the refrigerant gas X4, and the second compression stage 12 which further compresses the refrigerant compressed in one step.

An impeller 13 is provided in the first compression stage 11, an impeller 14 is provided in the second compression stage 12, and these impellers are connected by a rotating shaft 15. The turbo compressor 5 compresses the refrigerant by rotating the impellers 13 and 14 by a motor 10. Each of the impellers 13 and 14 is a radial impeller and has a blade which includes a three-dimensional twist (not shown) that radially leads out the refrigerant suctioned thereinto from axial direction.

An inlet guide vane 16 for regulating the intake amount of the first compression stage 11 is provided in the gas suction pipe 5*c*. The inlet guide vane 16 is made to be rotatable such that an apparent area from a flow direction of the refrigerant gas X4 can be changed. A diffuser flow path is provided around each of the impellers 13 and 14, and the refrigerant led out in a radial direction is compressed and put under increased pressure in the diffuser flow path. Further, it is possible to supply the refrigerant to the next compression stage by a scroll flow path further provided around the diffuser flow path. An outlet throttle valve 17 is provided around the impeller 14 and can control the discharge amount from the gas discharge pipe 5*a*.

The turbo compressor 5 is provided with a hermetic type casing 20. The casing 20 is partitioned into a compression flow path space S1, a first bearing accommodation space S2, a motor accommodation space S3, a gear unit accommodation space S4, and a second bearing accommodation space S5. The casing 20 is formed by connecting a compressor casing 20*a* and a motor casing 20*b* through an adapter member 60 (described later).

The impellers 13 and 14 are provided in the compression flow path space S1. The rotating shaft 15 connecting the impellers 13 and 14 is provided to pass through the compression flow path space S1, the first bearing accommodation space S2, and the gear unit accommodation space S4. A bearing 21 supporting the rotating shaft 15 is provided in the first bearing accommodation space S2.

A stator 22, a rotor 23, and a rotating shaft 24 connected to the rotor 23 are provided in the motor accommodation space S3. The rotating shaft 24 is provided to pass through the motor accommodation space S3, the gear unit accommodation space S4, and the second bearing accommodation space S5. A bearing 31 supporting the anti-load side of the rotating shaft 24 is provided in the second bearing accommodation space S5. A gear unit 25, bearings 26 and 27, and an oil tank 28 are provided in the gear unit accommodation space S4.

The gear unit 25 has a large-diameter gear 29 which is fixed to the rotating shaft 24, and a small-diameter gear 30 which is fixed to the rotating shaft 15 and engaged with the large-diameter gear 29. The gear unit 25 transmits a rotating force such that the rotational frequency of the rotating shaft 15 increases with respect to the rotational frequency of the rotating shaft 24 (the rotational speed of the rotating shaft 15 increases). The bearing 26 supports the rotating shaft 24. The bearing 27 supports the rotating shaft 15. The oil tank 28 stores lubricating oil which is supplied to the respective sliding sites such as the bearings 21, 26, 27, and 31.

Seal parts 32 and 33 which seal the periphery of the rotating shaft 15 are provided in the casing 20 between the compression flow path space S1 and the first bearing accommodation space S2. Further, a seal part 34 which seals the periphery of the rotating shaft 15 is provided in the casing 20 between the compression flow path space S1 and the gear unit accommodation space S4. Further, a seal part 35 which seals the periphery of the rotating shaft 24 is provided in the casing 20 between the gear unit accommodation space S4 and the motor accommodation space S3. Further, a seal part 36 which seals the periphery of the rotating shaft 24 is provided in the casing 20 between the motor accommodation space S3 and the second bearing accommodation space S5.

Figure 3:
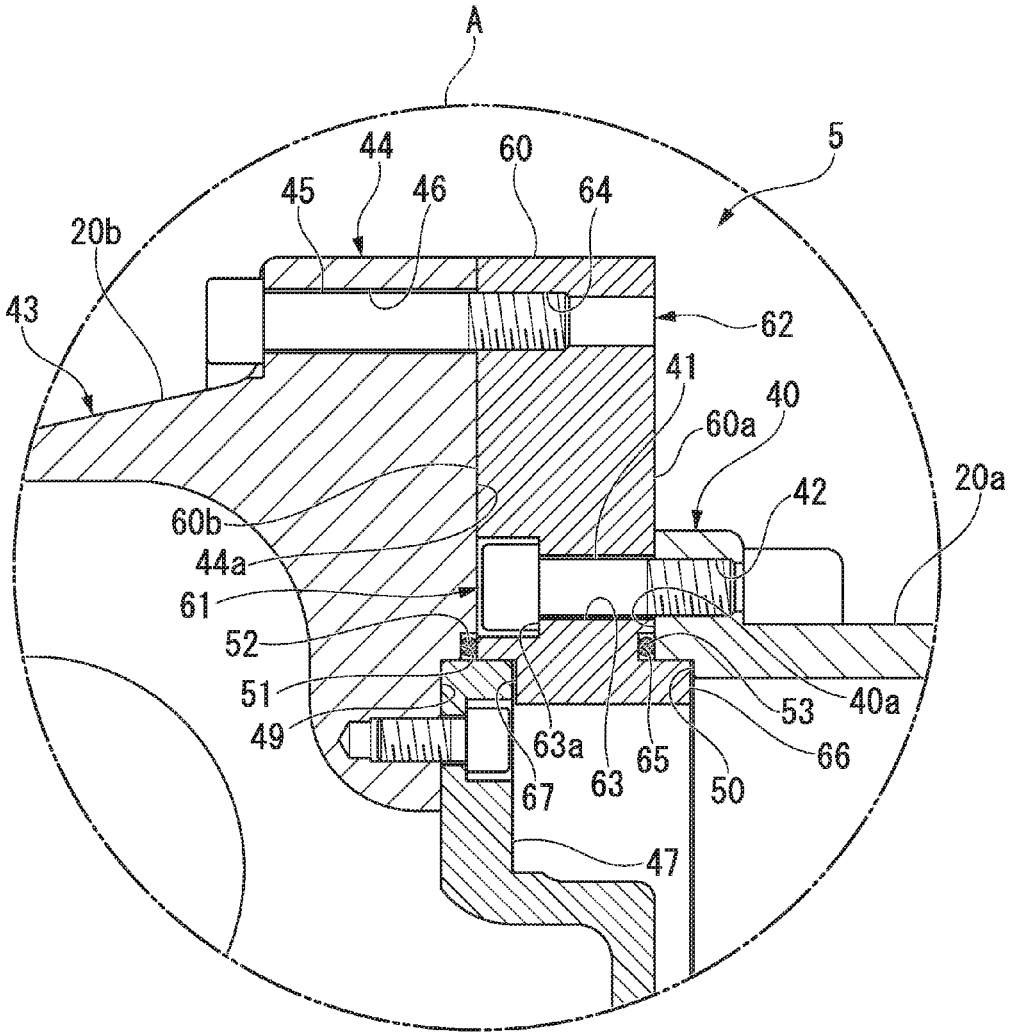
FIG. 3 is an enlarged view of an area A in FIG. 2.
Figure 4:
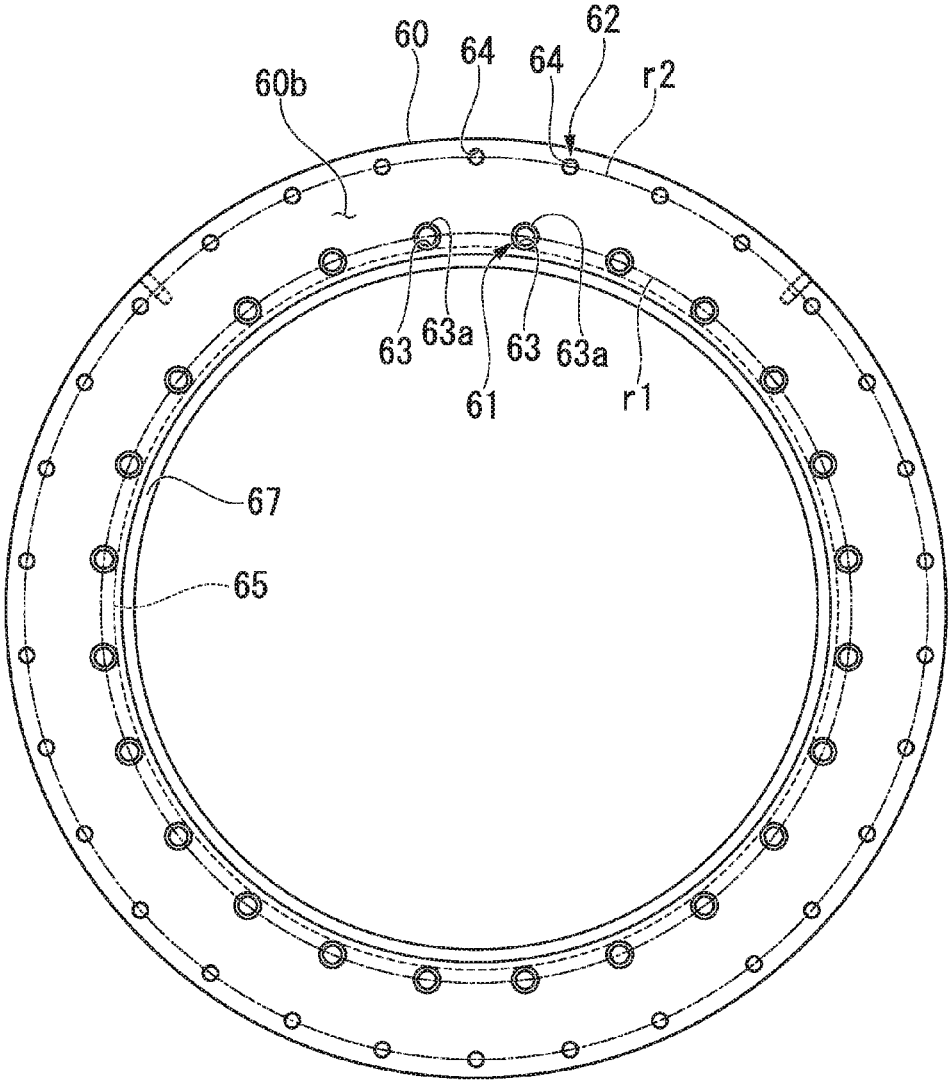
FIG. 4 is a left side view showing the adapter member in the embodiment of the present invention.

Next, a connection structure between the compressor casing 20*a* and the motor casing 20*b* in the turbo compressor 5 will be described with reference to FIGS. 2 to 4.

Figure 2:
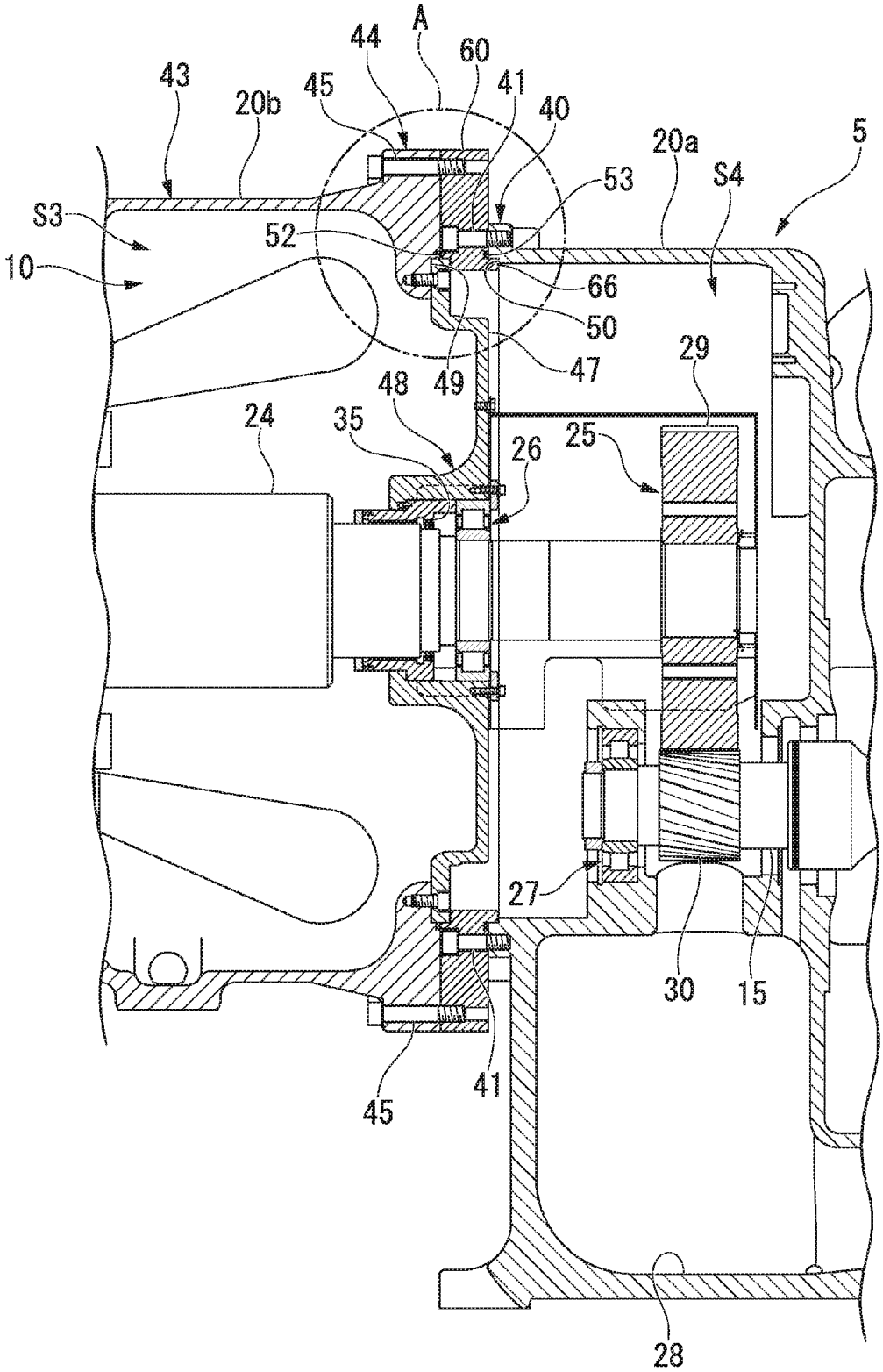
FIG. 2 is a sectional view showing a connection structure between a compressor casing and a motor casing through an adapter member in the embodiment of the present invention.

FIG. 2 is a sectional view showing the connection structure between the compressor casing 20*a* and the motor casing 20*b* through the adapter member 60 in the embodiment of the present invention. FIG. 3 is an enlarged view of an area A in FIG. 2. FIG. 4 is a left side view showing the adapter member 60 in the embodiment of the present invention.

As shown in FIG. 2, the compressor casing 20*a* and the motor casing 20*b* are connected through the adapter member 60. The compressor casing 20*a* has a mounting flange 40 formed in an annular shape. A screw hole 42 into which a connecting bolt 41 is screwed is formed in the mounting flange 40, as shown in FIG. 3. The screw holes 42 are provided in a plurality at intervals in a circumferential direction of the mounting flange 40.

As shown in FIG. 2, the motor casing 20*b* has a cylindrical main body part 43 which accommodates the motor 10. The motor 10 for the turbo refrigerator 1 has a voltage width in a range of several hundreds of volts to several tens of thousands of volts, for example, and the diameter thereof can be greatly changed according to the level of voltage. The main body part 43 has a cylindrical shape and the shape thereof is simple. Therefore, the main body part 43 can be easily formed in a size corresponding to the motor 10 whose diameter can be greatly changed according to the level of voltage. The main body part 43 of this embodiment has a larger diameter than the mounting flange 40 of the compressor casing 20*a*.

The motor casing 20*b* has a mounting flange 44 formed in an annular shape. An insertion hole 46 into which a connecting bolt 45 is inserted is formed in the mounting flange 44, as shown in FIG. 3. The insertion holes 46 are provided in a plurality at intervals in the circumferential direction of the mounting flange 44.

The mounting flange 44 is formed at an end portion of the main body part 43 and has a diameter greater than the diameter of the main body part 43. For this reason, the screw hole 42 of the compressor casing 20*a* and the insertion hole 46 of the motor casing 20*b* do not conform to each other.

The motor casing 20*b* has a closing cover 47 which closes the motor accommodation space S3, as shown in FIG. 2. The closing cover 47 is bolted to the end portion of the main body part 43. The closing cover 47 has a holding portion 48 which holds the bearing 26 and the seal part 35. The closing cover 47 is spigot-fitted into a groove 49 formed in an end face 44*a* of the mounting flange 44, as shown in FIG. 3. The thickness of the closing cover 47 is greater than the depth of the groove 49, and thus the closing cover 47 protrudes further than the end face 44*a* of the mounting flange 44. Further, the closing cover 47 is formed in a size capable of being also spigot-fitted into a groove 50 formed in an end face 40*a* of the mounting flange 40 (refer to FIG. 5 which will be described later).

An annular groove 51 is formed around the closing cover 47. The annular groove 51 is a groove formed in the end face 44*a* of the mounting flange 44 and is formed to be shallower than the groove 49. An O-ring 52 (a second seal member) which performs airtight sealing between the motor casing 20*b* and the adapter member 60 is disposed in the annular groove 51. The O-ring 52 has the same diameter as an O-ring 53 (a first seal member) which performs airtight sealing between the compressor casing 20*a* and the adapter member 60.

The adapter member 60 is a plate-shaped connection member which is interposed between the compressor casing 20*a* and the motor casing 20*b*. The adapter member 60 is formed in an annular shape, as shown in FIG. 4. The adapter member 60 is provided with a first connection portion 61 which can be connected to the mounting flange 40 provided in the compressor casing 20*a*, in a first diameter r1, and a second connection portion 62 which can be connected to the mounting flange 44 provided in the motor casing 20*b*, in a second diameter r2.

The first connection portion 61 has an insertion hole 63 into which the connecting bolt 41 is inserted. The insertion holes 63 are provided in a plurality at intervals in the first diameter r1. A countersink 63*a* for preventing a head of the connecting bolt 41 from protruding from a connection surface 60*b* on the motor casing 20*b* side of the adapter member 60 is formed around the insertion hole 63 (refer to FIG. 3).

The second connection portion 62 has a screw hole 64 into which the connecting bolt 45 is screwed. The screw holes 64 are provided in a plurality at intervals in the second diameter r2 greater than the first diameter r1.

Further, the adapter member 60 has an annular groove 65 in which the O-ring 53 is disposed. The annular groove 65 has a diameter smaller than the first diameter r1, as shown in FIG. 4. The diameter of the annular groove 65 is the same as the diameter of the annular groove 51 (refer to FIG. 3) in which the O-ring 52 is disposed. The annular groove 65 of this embodiment is formed in a connection surface 60*a* on the compressor casing 20*a* side of the adapter member 60, as shown in FIG. 3.

A projection 66 protruding farther than the connection surface 60*a* is formed further toward the inner diameter side than the annular groove 65.

The projection 66 is formed in an annular shape and is spigot-fitted into the groove 50 formed in the end face 40*a* of the mounting flange 40. Further, a groove 67 is formed in the connection surface 60*b* on the back side of the projection 66. The closing cover 47 protruding from the end face 44*a* of the mounting flange 44 is spigot-fitted into the groove 67. In this manner, the compressor casing 20*a* side and the motor casing 20*b* side of the adapter member 60 have spigot-fitting shapes which are correlated with each other, and thus misalignment or the like of the rotating shaft 24 shown in FIG. 2 can be prevented.

Subsequently, an action by the turbo compressor 5 having the above-described configuration will be described with reference to FIGS. 5, 6A, and 6B.

Figure 5:
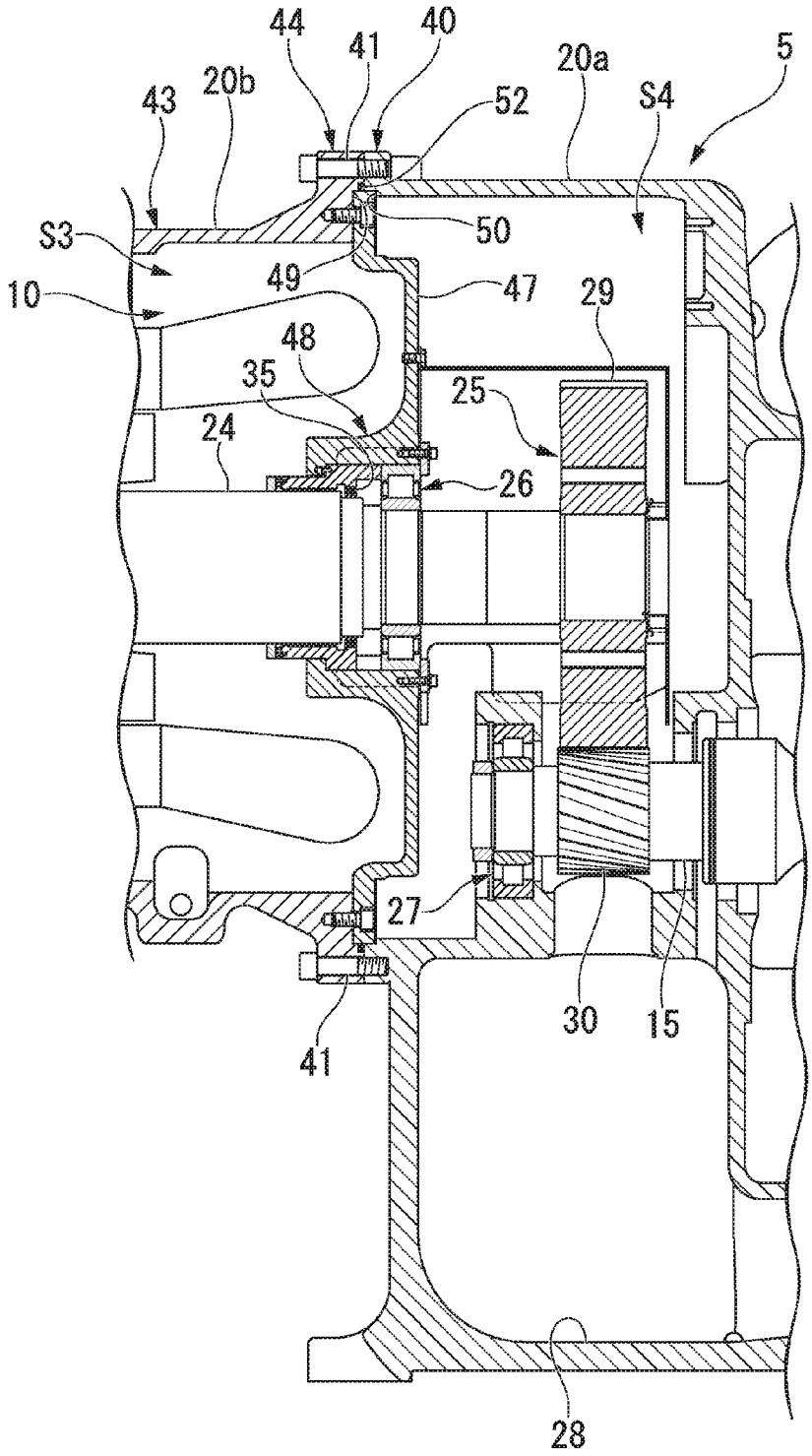
FIG. 5 is a sectional view showing a connection structure (a direct connection structure) between the compressor casing and the motor casing without the interposition of the adapter member in the embodiment of the present invention.
Figure 6A:
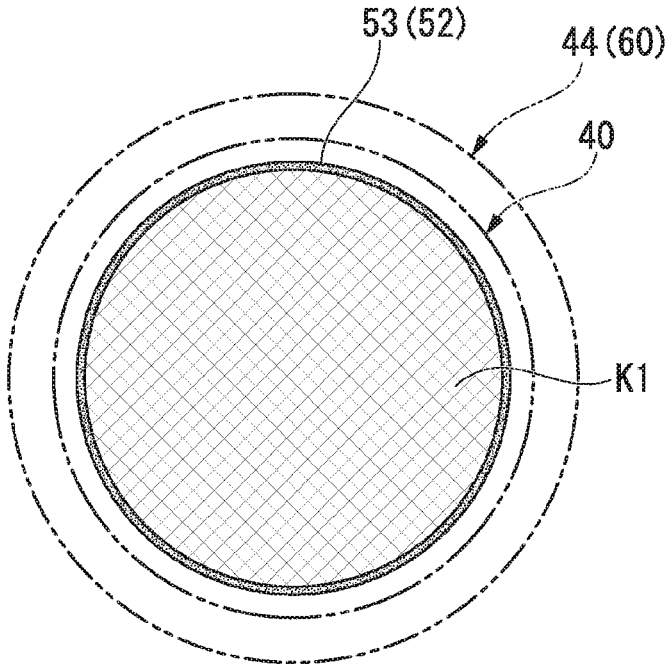
FIG. 6A is a diagram schematically showing a pressure receiving area to which pressure is applied, in a connection portion between the compressor casing and the motor casing in the embodiment of the present invention.
Figure 6B:
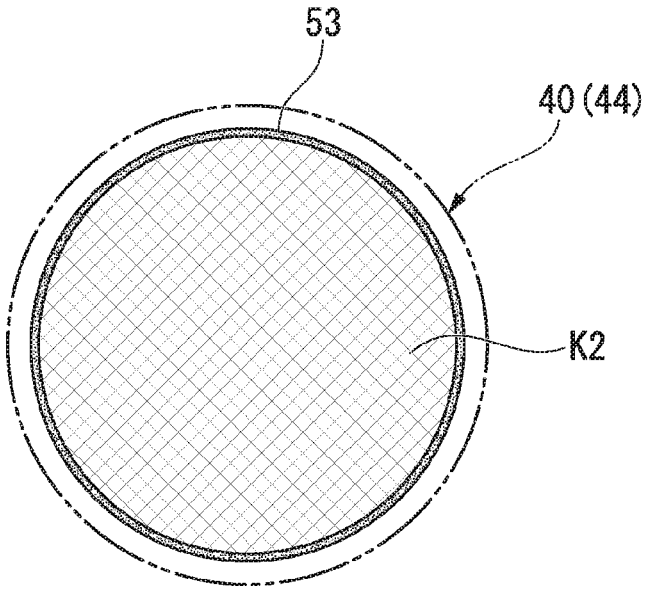
FIG. 6B is a diagram schematically showing a pressure receiving area to which pressure is applied, in a connection portion between the compressor casing and the motor casing in the embodiment of the present invention.

FIG. 5 is a sectional view showing a connection structure (a direct connection structure) between the compressor casing 20*a* and the motor casing 20*b* without the interposition of the adapter member 60 in the embodiment of the present invention. FIGS. 6A and 6B are diagrams schematically showing a pressure receiving area to which pressure is applied, in a connection portion between the compressor casing 20*a* and the motor casing 20*b* in the embodiment of the present invention. In addition, FIG. 6A shows a pressure receiving area K1 of the connection structure shown in FIG. 2. FIG. 6B shows a pressure receiving area K2 of the connection structure shown in FIG. 5.

As shown in FIG. 5, in a case where the diameter of the main body part 43 of the motor casing 20*b* is smaller than that of the mounting flange 40 of the compressor casing 20*a*, the mounting flange 40 of the compressor casing 20*a* and the mounting flange 44 of the motor casing 20*b* can be fitted to each other and directly connected by the connecting bolt 41.

However, as shown in FIG. 2, in a case where the diameter of the main body part 43 of the motor casing 20*b* is made to be greater than the diameter of the mounting flange 40 of the compressor casing 20*a* according to the specification of the voltage of the motor 10, the compressor casing 20*a* and the motor casing 20*b* cannot be directly connected.

On the other hand, in a case where the diameter of the main body part 43 of the motor casing 20*b* is smaller than the diameter shown in FIG. 5, it is possible to cope with it only by changing the size of the motor casing 20*b* having a simple shape (for example, extending the mounting flange 44 of the motor casing 20*b*, or the like).

In contrast, in a case where the diameter of the main body part 43 of the motor casing 20*b* is greater than the diameter of the mounting flange 40 of the compressor casing 20*a*, if coping with it is performed by changing the shape of the compressor casing 20*a*, since the compressor casing 20*a* has a complicated shape and is expensive due to formation by casting, an inventory cost or an inventory location is also required.

Therefore, in this embodiment, the adapter member 60 is separately prepared, and thus even if the size of the motor casing 20*b* is changed, it is possible to cope with it through the interposition of the adapter member 60 without changing the size of the compressor casing 20*a*. The adapter member 60 has the first connection portion 61 which can be connected to the mounting flange 40 provided in the compressor casing 20*a*, in the first diameter r1, and the second connection portion 62 which can be connected to the mounting flange 44 provided in the motor casing 20*b*, in the second diameter r2 greater than the first diameter r1. For this reason, in this embodiment, as shown in FIG. 2, it is possible to connect the compressor casing 20*a* and the motor casing 20*b* which are different in size from each other, by interposing the adapter member 60 therebetween.

In this manner, according to this embodiment, the adapter member 60 having a simple shape is prepared, and thus even if the size of the motor casing 20*b* is changed due to a change in the specification of the voltage of the motor 10, it is possible to cope with it only by changing the adapter member 60 without changing the size of the compressor casing 20*a*. Therefore, in this embodiment, as the compressor casing 20*a*, one type of common compressor casing can be used without being influenced by the level of the voltage of the motor 10, and therefore, it is not necessary to prepare plural types of compressor casings 20*a* or expensive parts which are accommodated therein, and inventory can be minimized. Therefore, an inventory location or an inventory costs can be minimized.

Incidentally, if the compressor casing 20*a* and the motor casing 20*b* are connected by interposing the adapter member 60 therebetween, as is apparent from comparison with the configuration shown in FIG. 5, one connection place between the compressor casing 20*a* and the motor casing 20*b* further increases. For this reason, it is necessary to additionally dispose the O-ring 53 in order to prevent leakage of the refrigerant gas X4 from the connection place. Therefore, in this embodiment, as shown in FIG. 3, the annular groove 65 is formed in the adapter member 60, and the O-ring 53 is disposed therein, thereby performing airtight sealing between the adapter member 60 and the compressor casing 20*a*. According to this configuration, it is possible to dispose the additional O-ring 53 without changing the shape of the compressor casing 20*a*. Further, the annular groove 65 has a diameter smaller than the first diameter r1, as shown in FIG. 4, and thus it is possible to effectively prevent leakage of the refrigerant gas X4 through the insertion hole 63 or the like of the first connection portion 61.

Further, in this embodiment, as shown in FIG. 2, the O-ring 53 which seals the connection place of the compressor casing 20*a* which is generated due to the interposition of the adapter member 60 has the same diameter as the O-ring 52 which seals the connection place of the motor casing 20*b*. According to this configuration, the size of the pressure receiving area K1 of this embodiment shown in FIG. 6A can be maintained at the same size as the pressure receiving area K2 of the form of directly connecting the compressor casing 20*a* and the motor casing 20*b* shown in FIG. 6B. For this reason, in this embodiment, a force which tries to separate the compressor casing 20*a* and the motor casing 20*b* from each other by internal pressure does not change, and thus it is possible to connect the compressor casing 20*a* and the motor casing 20*b* without increasing the diameters of the connecting bolts 41 and 44, or the like.

In this manner, the above-described embodiment relates to the turbo compressor 5 which is provided with the compressor casing 20*a* which accommodates the impellers 13 and 14 which compress the refrigerant gas X4 by rotation, and the motor casing 20*b* which accommodates the motor 10 rotating the impellers 13 and 14, in which the motor casing 20*b* has the cylindrical main body part 43 having a larger diameter than the mounting flange 40 provided in the compressor casing 20*a*, and the compressor casing 20*a* and the motor casing 20*b* are connected through the adapter member 60. For this reason, the turbo compressor 5 and a turbo refrigerator are obtained in which connection of the compressor casing 20*a* and the motor casing 20*b* is possible without changing the size of the compressor casing 20*a*.

The preferred embodiment of the present invention has been described above with reference to the drawings. However, the present invention is not limited to the embodiment described above. The shapes, the combination, or the like of the respective constituent members shown in the embodiment described above is one example and various changes can be made based on design requirements or the like within a scope of the present invention.

Figure 7:
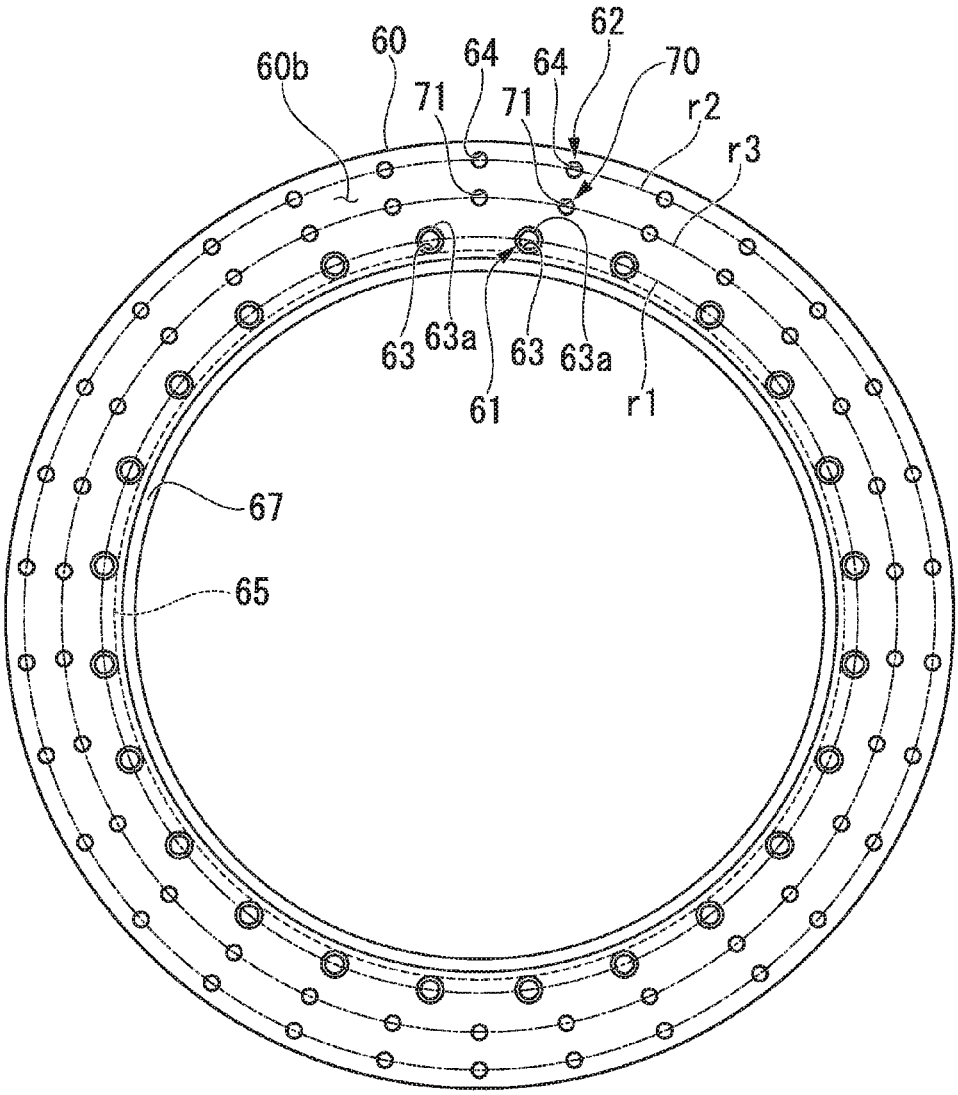
FIG. 7 is a left side view showing an adapter member in another embodiment of the present invention.

For example, the configuration shown in FIG. 7 may be adopted. In addition, in FIG. 7, constituent portions equal or equivalent to those in the above-described embodiment are denoted by the same reference numerals.

FIG. 7 is a left side view showing the adapter member 60 in another embodiment of the present invention.

As shown in FIG. 7, the adapter member 60 in another embodiment has a third connection portion 70. The third connection portion 70 can be connected to the mounting flange 44 provided in the motor casing 20*b*, in a third diameter r3. The third diameter r3 is greater than the first diameter r1 and smaller than the second diameter r2. The third connection portion 70 has a screw hole 71 into which the connecting bolt 45 is screwed. The screw holes 71 are provided in a plurality at intervals in the third diameter r3. According to this configuration, not only a large-sized motor casing 20*b*, but also a medium-sized motor casing 20*b* can be connected, and therefore, the inventory of the adapter member 60 can be reduced. Further, even if the third connection portion 70 is provided, if the O-rings 52 and 53 are disposed further toward the inner diameter side than the first connection portion 61, as shown in FIG. 3, it is possible to prevent leakage of gas.

Further, for example, in the embodiments described above, a configuration in which the annular groove in which the seal member is disposed is formed on the compressor casing side of the adapter member has been described. However, the present invention is not limited to this configuration. For example, if an annular groove in which the seal member is disposed has been originally formed in the compressor casing, a configuration in which the annular groove in which the seal member is disposed is not formed on the compressor casing side of the adapter member may be adopted.

INDUSTRIAL APPLICABILITY

According to the present invention, a turbo compressor and a turbo refrigerator are obtained in which connection of a compressor casing and a motor casing is possible without changing the size of the compressor casing.

REFERENCE SIGNS LIST

1: turbo refrigerator
2: condenser
4: evaporator
5: turbo compressor
10: motor
13: impeller
14: impeller
20*a*: compressor casing
20*b*: motor casing
40: mounting flange
43: main body part
44: mounting flange
52: O-ring (second seal member)
53: O-ring (seal member, first seal member)
60: adapter member
61: first connection portion
62: second connection portion
65: annular groove
r1: first diameter
r2: second diameter

The invention claimed is:

1. A turbo compressor comprising:
a compressor casing which accommodates an impeller compressing gas by rotation; and
a motor casing which accommodates a motor rotating the impeller, wherein
the motor casing has a cylindrical main body part having a larger diameter than a mounting flange provided in the compressor casing,
the compressor casing and the motor casing are connected through an adapter member, and
the adapter member has
a first connection portion which can be connected to the mounting flange provided in the compressor casing, in a first diameter, and
a second connection portion which can be connected to a mounting flange provided in the motor casing, in a second diameter greater than the first diameter.

2. The turbo compressor according to claim 1, wherein the adapter member has an annular groove in which a seal member, which performs airtight sealing between the adapter member and the compressor casing or the motor casing, is disposed.

3. The turbo compressor according to claim 2, wherein the annular groove has a diameter smaller than the first diameter.

4. The turbo compressor according to claim 3, further comprising:

a first seal member which performs airtight sealing between the compressor casing and the adapter member; and a second seal member which performs airtight sealing between the motor casing and the adapter member, wherein the first seal member and the second seal member have the same diameter.

5. The turbo compressor according to claim 2, further comprising:

a first seal member which performs airtight sealing between the compressor casing and the adapter member; and a second seal member which performs airtight sealing between the motor casing and the adapter member, wherein the first seal member and the second seal member have the same diameter.

6. A turbo refrigerator comprising:

a condenser which liquefies a compressed refrigerant;

an evaporator which evaporates the refrigerant liquefied by the condenser, thereby cooling a cooling object; and the turbo compressor according to claim 5, which compresses the refrigerant evaporated by the evaporator and supplies the compressed refrigerant to the condenser.

7. A turbo refrigerator comprising:

a condenser which liquefies a compressed refrigerant;

an evaporator which evaporates the refrigerant liquefied by the condenser, thereby cooling a cooling object; and the turbo compressor according to claim 1, which compresses the refrigerant evaporated by the evaporator and supplies the compressed refrigerant to the condenser.

8. The turbo compressor according to claim 1, further comprising:

a first seal member which performs airtight sealing between the compressor casing and the adapter member; and a second seal member which performs airtight sealing between the motor casing and the adapter member, wherein the first seal member and the second seal member have the same diameter.

9. A turbo refrigerator comprising:

a condenser which liquefies a compressed refrigerant;

an evaporator which evaporates the refrigerant liquefied by the condenser, thereby cooling a cooling object; and the turbo compressor according to claim 8, which compresses the refrigerant evaporated by the evaporator and supplies the compressed refrigerant to the condenser.

10. A turbo compressor comprising:

a compressor casing which accommodates an impeller compressing gas by rotation; and a motor casing which accommodates a motor rotating the impeller, wherein the motor casing has a cylindrical main body part having a larger diameter than a mounting flange provided in the compressor casing, the compressor casing and the motor casing are connected through an adapter member, the turbo compressor further comprises a first seal member which performs airtight sealing between the compressor casing and the adapter member; and a second seal member which performs airtight sealing between the motor casing and the adapter member, the adapter member has a first connection portion having a first diameter and connected to the mounting flange provided in the compressor casing, and a second connection portion having a second diameter, which is larger than the first diameter, and connected to a mounting flange provided in the motor casing, and each of the first and second seal members has a diameter smaller than the first diameter.

11. A turbo compressor comprising:

a compressor casing which accommodates an impeller compressing gas by rotation; and a motor casing which accommodates a motor rotating the impeller, wherein the compressor casing and the motor casing are connected through an adapter member, and the adapter member has a first connection portion which can be connected to the mounting flange provided in the compressor casing, in a first diameter, and a second connection portion which can be connected to a mounting flange provided in the motor casing, in a second diameter greater than the first diameter.

* * * * *